United States Patent [19]

Cartabbia

[11] Patent Number: 5,075,989

[45] Date of Patent: Dec. 31, 1991

[54] APPARATUS FOR AUTOMATICALLY AND SIMULTANEOUSLY IRONING SHIRT FRONT, REAR AND TOP PORTIONS

[76] Inventor: Giovanni Cartabbia, Via Piantada, 9/D, 25036 Palazzolo Sull'oglio (Brescia), Italy

[21] Appl. No.: 600,534

[22] Filed: Oct. 19, 1990

[30] Foreign Application Priority Data

Oct. 26, 1989 [IT] Italy ..... 22136 A/89

[51] Int. Cl.[5] ..... D06F 71/20

[52] U.S. Cl. ..... 38/6; 38/7; 38/14; 223/57; 223/70

[58] Field of Search ..... 38/5, 6, 7, 12, 70, 38/143, 14; 223/51, 52, 52.1, 57, 66–68, 70, 72–74, 111

[56] References Cited

U.S. PATENT DOCUMENTS

| | | | |
|---|---|---|---|
| 3,063,606 | 11/1962 | Davis | 223/73 X |
| 3,273,765 | 9/1966 | Piilola | 223/72 X |
| 3,378,178 | 4/1968 | Stewart | 223/73 X |
| 3,471,067 | 10/1969 | Stewart | 223/57 |
| 3,568,900 | 3/1971 | Paris | 223/70 |
| 3,715,064 | 2/1973 | North et al. | 223/70 X |
| 4,057,179 | 11/1977 | Everett | 223/73 |
| 4,351,457 | 9/1982 | Engelbart | 38/6 X |
| 4,423,561 | 1/1984 | Cartabbia | 223/70 X |
| 4,634,030 | 1/1987 | Uchikoshi | 223/70 X |
| 4,728,015 | 3/1988 | Holzapfel et al. | 223/70 |

FOREIGN PATENT DOCUMENTS

| | | | |
|---|---|---|---|
| 2196652 | 5/1988 | United Kingdom | 223/52 |

*Primary Examiner*—Werner H. Schroeder
*Assistant Examiner*—Israel Izaguirre
*Attorney, Agent, or Firm*—Bucknam and Archer

[57] ABSTRACT

An apparatus for automatically and simultaneously ironing front, rear and top portions of a shirt comprises two vertical movable ironing plates therebetween there is provided a dummy bearing a shirt to be ironed, the dummy including an upwardly movable top portion and the ironing plates having two concave top seats negatively reproducing the profile of the top of the dummy, the apparatus further comprising gripping elements to automatically grip and transfer the ironed shirt.

5 Claims, 9 Drawing Sheets

2
2'
3'
1
1'
6
3

APPARATUS FOR AUTOMATICALLY AND SIMULTANEOUSLY IRONING SHIRT FRONT, REAR AND TOP PORTIONS

BACKGROUND OF THE INVENTION

The present invention relates to an apparatus for automatically and simultaneously ironing shirt front, rear and top portions, which has been specifically designed to be used in the cloth article making industry.

As is known any cloth article must be suitably ironed in order to remove therefrom the cloth folds.

On the other hand, at present for ironing shirts there are only available apparatus provided for ironing the front and rear portions of the shirts.

Then, by using such an apparatus, it is necessary to carry out other shirt processing steps, for ironing, for example, the sleeves, the shoulders and neck of the shirts.

These further processing steps, as it should be apparent require a lot of expensive labor which negatively affects the cost of the finished cloth article.

Moreover, in conventional shirt ironing apparatus, the partially ironed shirts are manually taken from their supporting dummy, in order to be subjected to a further shirt body ironing step, which further increases the cost of the finished product.

SUMMARY OF THE INVENTION

Accordingly, the aim of the present invention is to overcome the abovementioned drawbacks, by providing a shirt ironing apparatus, for industrial use, which is specifically designed to reduce the shirt ironing time to a minimum.

Within the scope of the above aim, a main object of the present invention is to provide a shirt ironing apparatus, for industrial use, which is adapted to simultaneously iron the body and shoulder portions of the shirts.

Another object of the present invention is to provide such a shirt ironing apparatus for industrial use, which also comprises a device for automatically take up an ironed shirt from its supporting dummy.

According to one aspect of the present invention, the above mentioned aim and objects, as well as yet other objects, which will become more apparent hereinafter, are achieved by an apparatus for automatically and simultaneously ironing shirt front, rear and top portions, characterized in that said apparatus essentially comprises two vertically extending cooperating ironing plate adapted to be driven towards one another, therebetween there is arranged a dummy bearing a shirt to be ironed and a top portion of which is adapted to be upward driven, said two plates defining, at a top portion thereof, two concave seats, one of which extends from an intermediate discontinuous portion, said concave seats defining a negative profile of the top portion of said dummy, means being moreover provided for gripping and transferring an ironed shirt.

BRIEF DESCRIPTION OF THE DRAWINGS

Further characteristics and advantages of the ironing apparatus according to the present invention will become more apparent from the following detailed description of a preferred embodiment thereof, which is illustrated, by way of a merely indicative example, in the figures of the accompanying drawings, where.

DESCRIPTION OF THE PREFERRED EMBODIMENT

Figure 1:
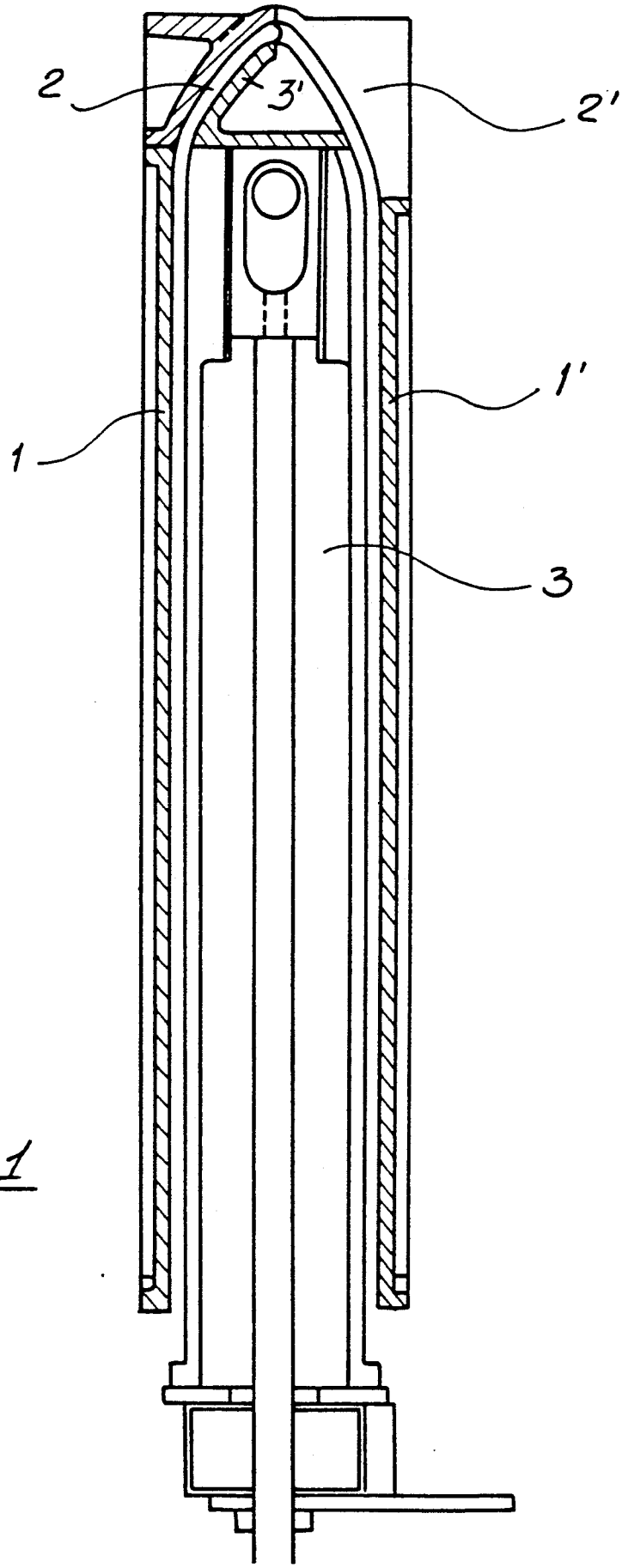
FIG. 1 is a schematic cross-section view of the dummy and two ironing plates included in the ironing apparatus according to the invention.
Figure 2:
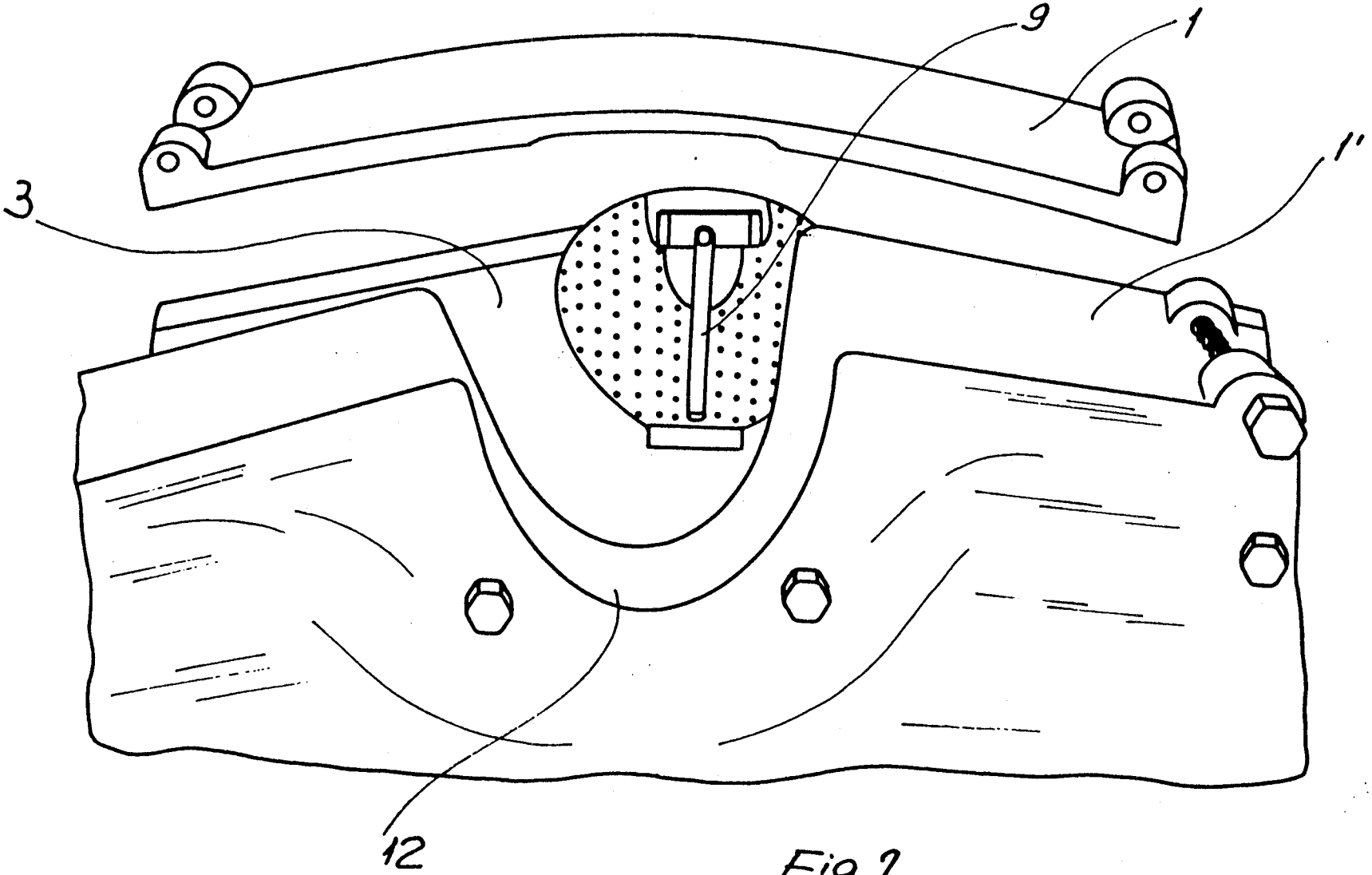
FIG. 2 is a top perspective view of the dummy, the ironing plates being arranged at a position removed from said dummy.
Figure 3:
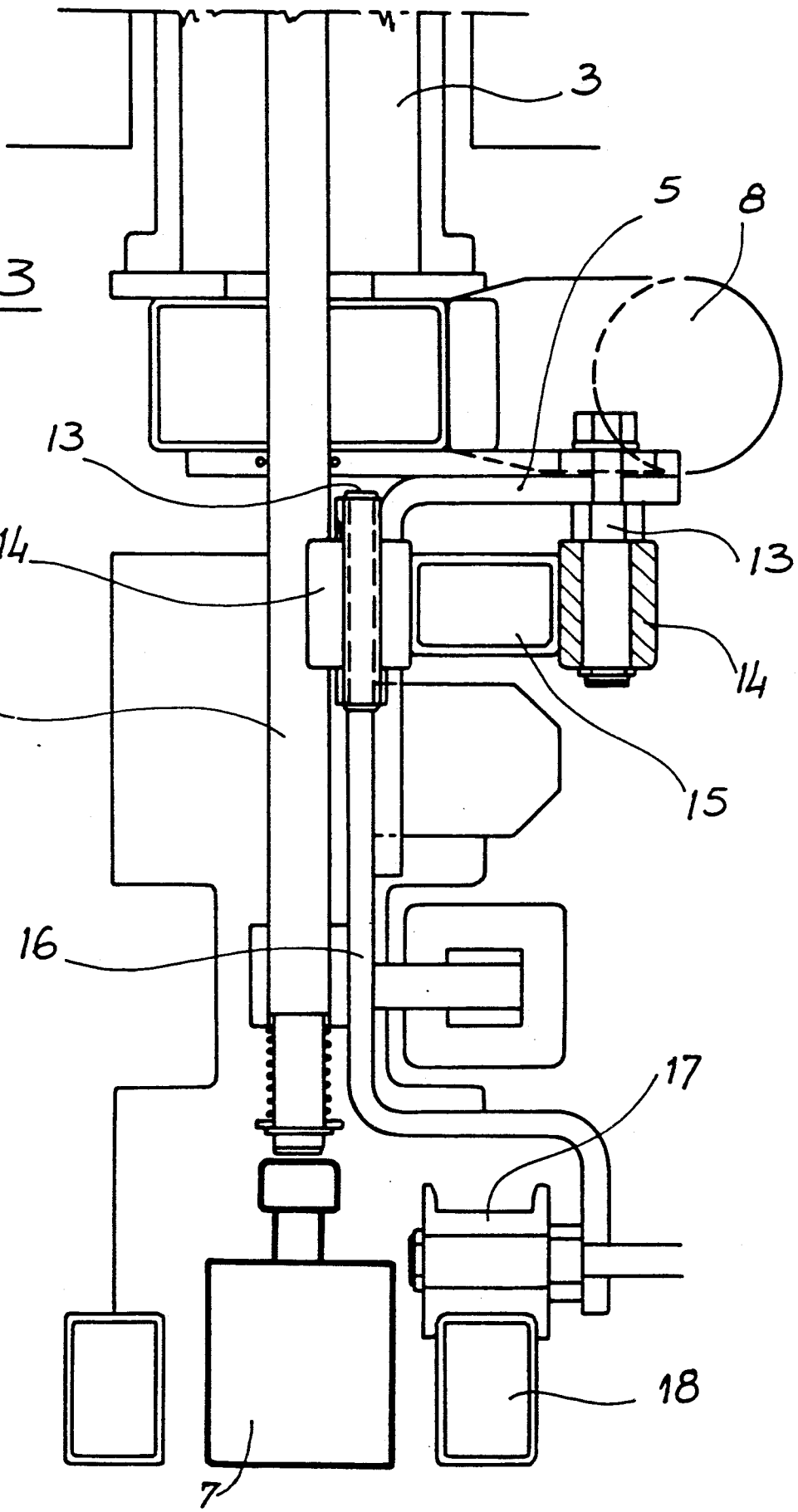
FIG. 3 is a cross-sectional view of a structure provided for slidably supporting the dummy.

With reference to the figures of the accompanying drawings, the apparatus for automatically ironing shirts according to the present invention essentially comprises two vertical parallel ironing plates 1 and 1' which can be driven toward one another by suitable driving elements.

More specifically, these two plates have top portions thereof, indicated respectively at 2 and 2', which have a concave profile adapted to mate with the profile of the corresponding top portions of the dummy 3 supporting a shirt 4 to be ironed.

In this connection it should be pointed out that the mentioned dummy is supported by a shaped plate 5 and that its top portion 3' is adapted to be upward driven by a rod 6 which is resiliently biassed, said rod being operated by a pressing cylinder 7.

It should be moreover pointed out that the dummy is hollow and communicates with a sucking duct 8 provided for always holding the dummy under a negative pressure so as to cause the shirt to suitably adhere to the outer surface of the dummy.

The dummy is moreover provided, at the top thereof, with a restraining element 9, for restraining the neck portion 4' of the shirt and with an opposite cylinder pair 10 and 10'.

These cylinders are provided for reciprocating corresponding rods 11 and 11' which can be introduced into the sleeves 4'' of the shirt so as to hold these sleeves separated from the shirt body during the shirt ironing operation.

In one of the mentioned ironing plates, in particular, there is formed, at the dummy portion bearing the restraining element, an interruption 12 of half-round profile.

The dummy supporting plate 5 bears, at the bottom thereof, a pair of fork elements 13, provided with corresponding roller pairs 14 which can slide along the two sides of a first horizontal track 15.

The supporting plate, moreover, downward extends, by a doubly-bent portion 16 which supports two grooved rollers 17, which can slide on a second horizontal track or rail 18 provided for supporting the assembly.

The transfer of the dummy bearing thereon a shirt to be ironed, arranged between the two ironing plates, is performed by a double-acting cylinder 19 the rod of which is articulated to the above mentioned supporting plate.

Figure 4:
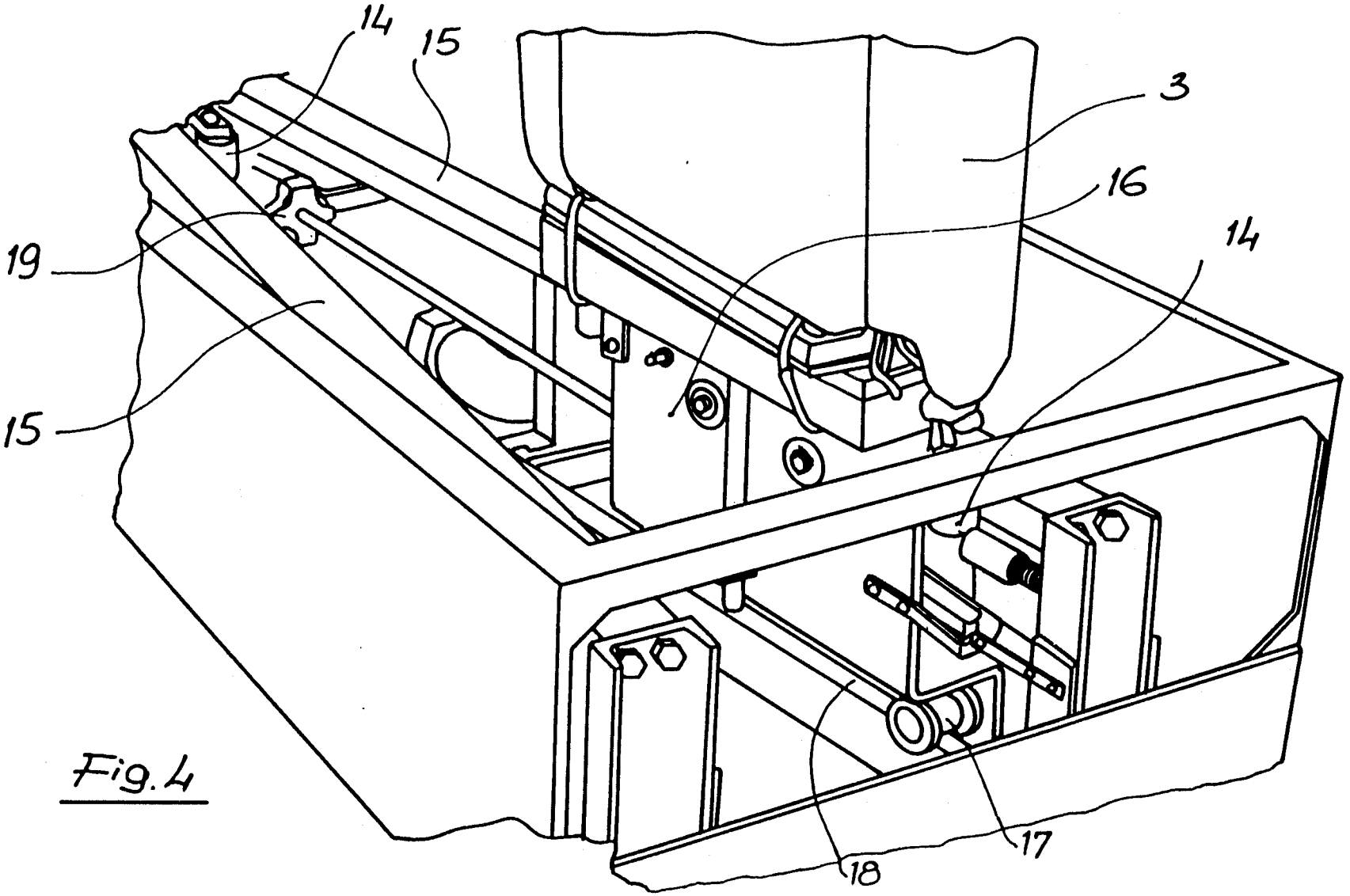
FIG. 4 is a perspective view showing the dummy supporting structure.

Advantageously, the apparatus according to the invention further comprises a rail double pair (as is clearly shown in FIG. 4) extending according to converging paths toward the ironing plates.

Thus, owing to this provision, as one of the dummy bearing a shirt to be ironed is arranged between the two ironing plates, the other dummy can be easily fitted with another shirt to be ironed.

Figures 5, 6, 7:
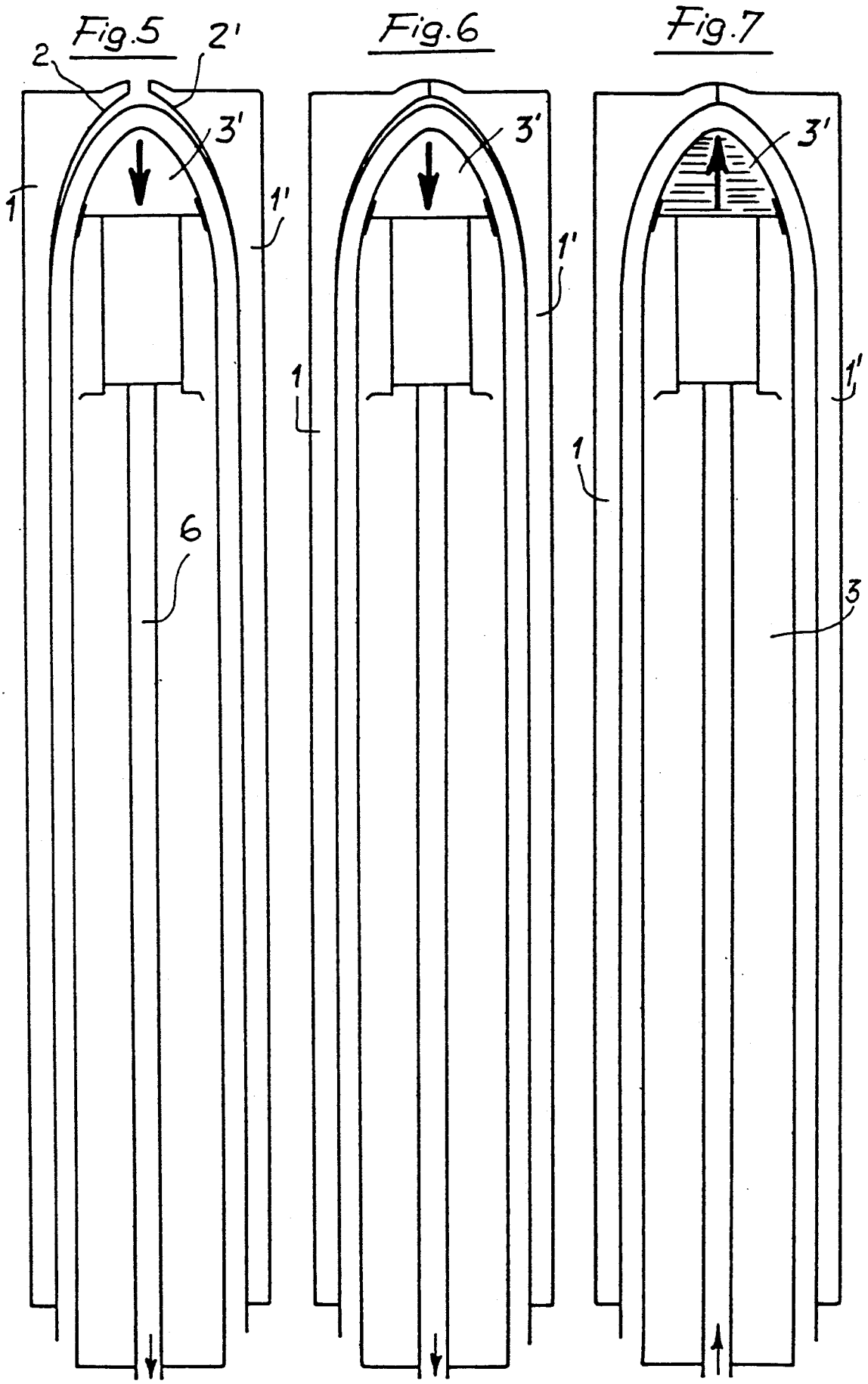
FIGS. 5, 6 and 7 show a possible ironing procedure for ironing a shirt by the apparatus according to the invention.
Figure 8:
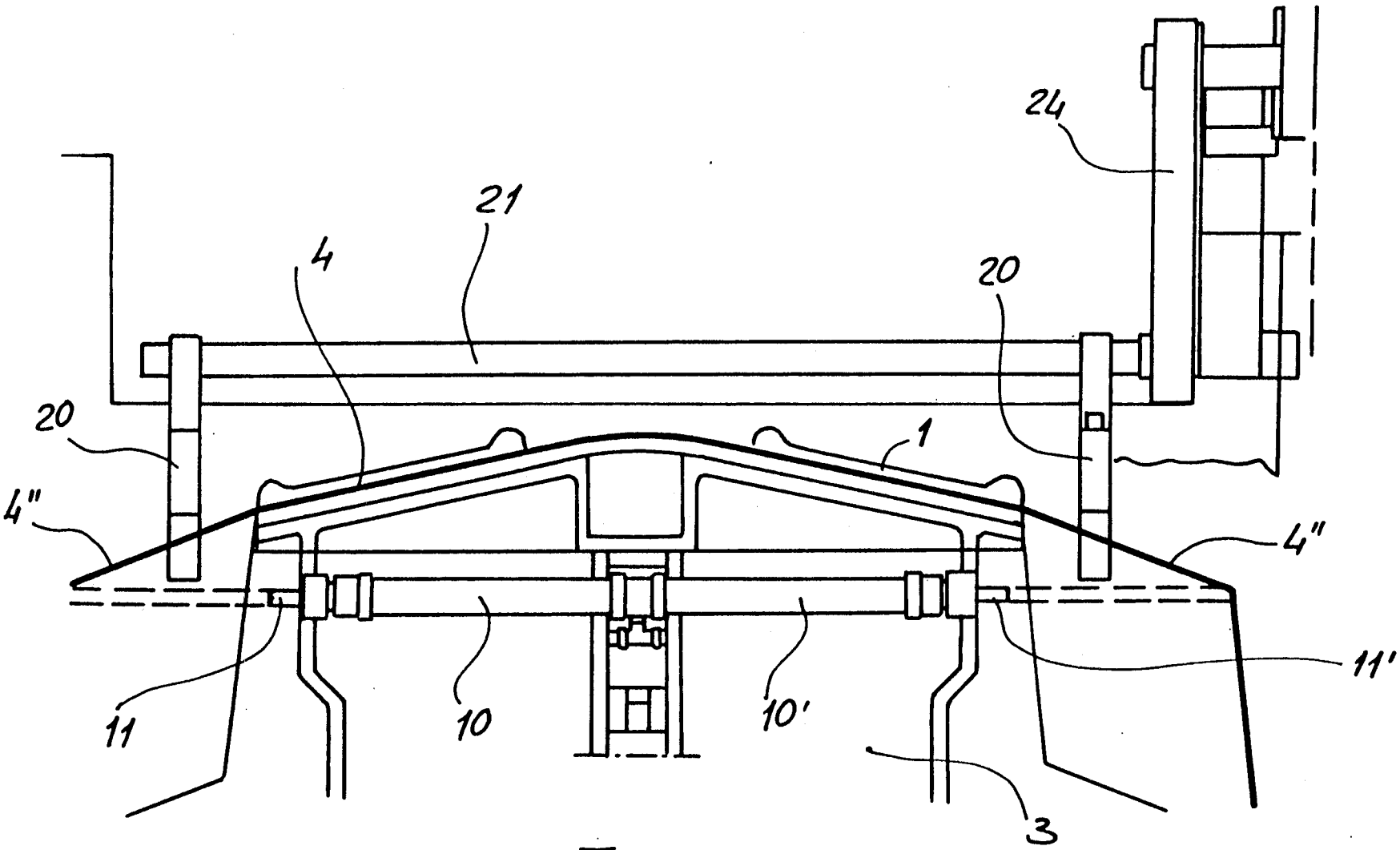
FIG. 8 shows elements for gripping and transferring an ironed shirt.

In operation, as is shown in FIG. 5, the dummy is displaced between the ironing plates which are driven toward one another so as to contact the shirt by a light pressure.

Simultaneously, there are actuated the side inflatable elements of the dummy so as to suitably spread the side portions of the shirt to be ironed.

Then (as is shown in FIG. 6), the plates 1 and 1' are forcedly closed so as to lock the dummy (with the exception of the top portion thereof) and the shirt.

Then, (see FIG. 7), the top portion 3' of the dummy, operated by the rod 6, is upward pushed so as to spread and press the shirt shoulder portions on said plates.

The ironing apparatus according to the present invention further comprises a device for removing from the dummy the ironed shirt, after having suitable moved away from one another the two plates and having opened the shirt neck restraining element 9.

In particular, this shirt removing or gripping device comprises a pair of pliers or grippers 20 mounted at the end portions of a tubular element 21 which is rotatably coupled to a supporting element 22 and bears rigid therewith a gear wheel 23.

This supporting element is firmly restrained to an arm 24, supported on a shaft 25, which is adapted to rotatively reciprocate into the two directions, by means of a driving reducing unit 26.

Coaxially with respect to the mentioned shaft there is provided a fixed supporting element 27 therewith there is rigid a further gear wheel 28 which, together with the first mentioned gear wheel, supports a chain 29.

Figure 9:
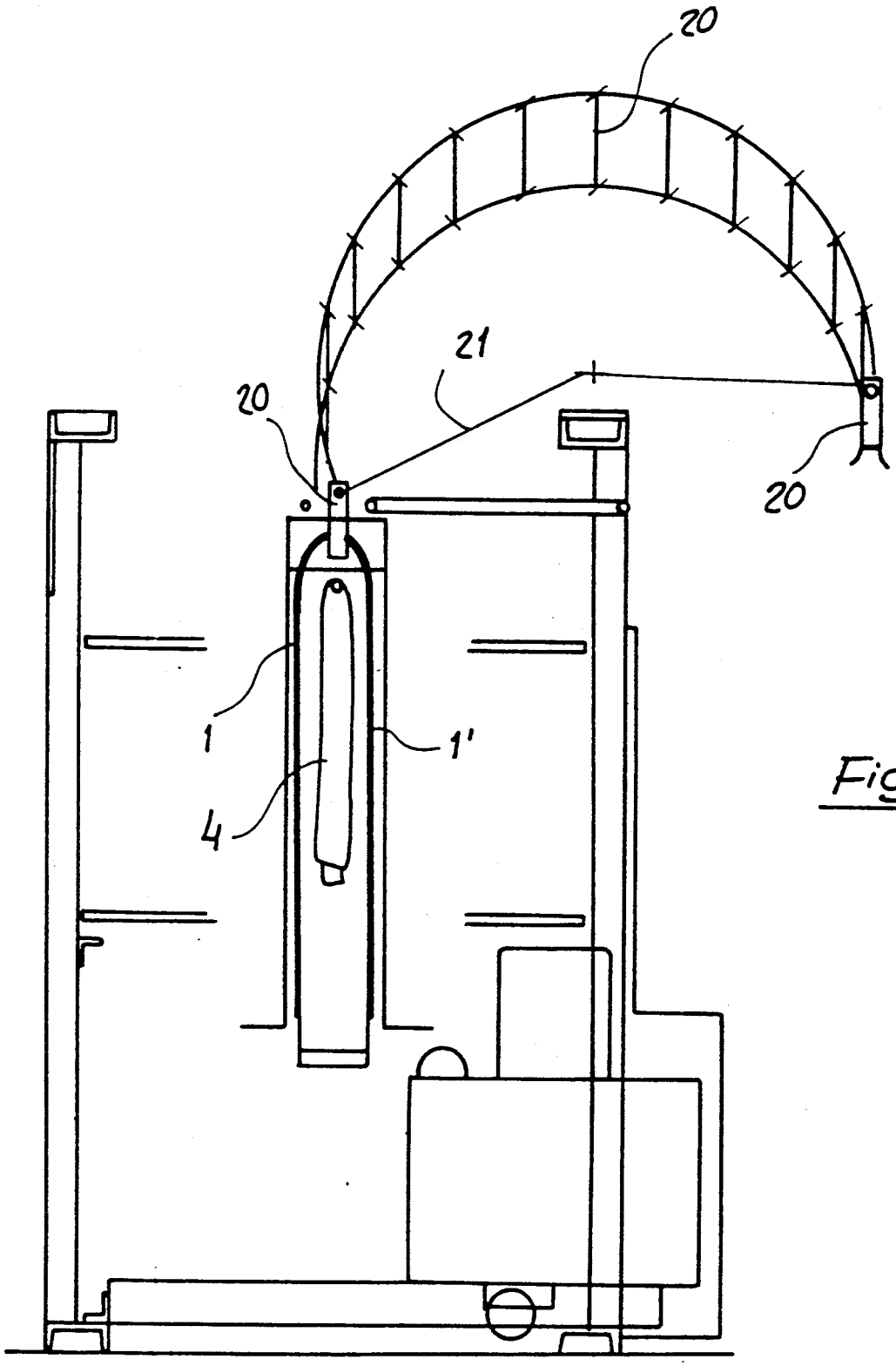
FIG. 9 schematically illustrates a driving path of an arm element bearing the above mentioned shirt gripping elements.
Figure 10:
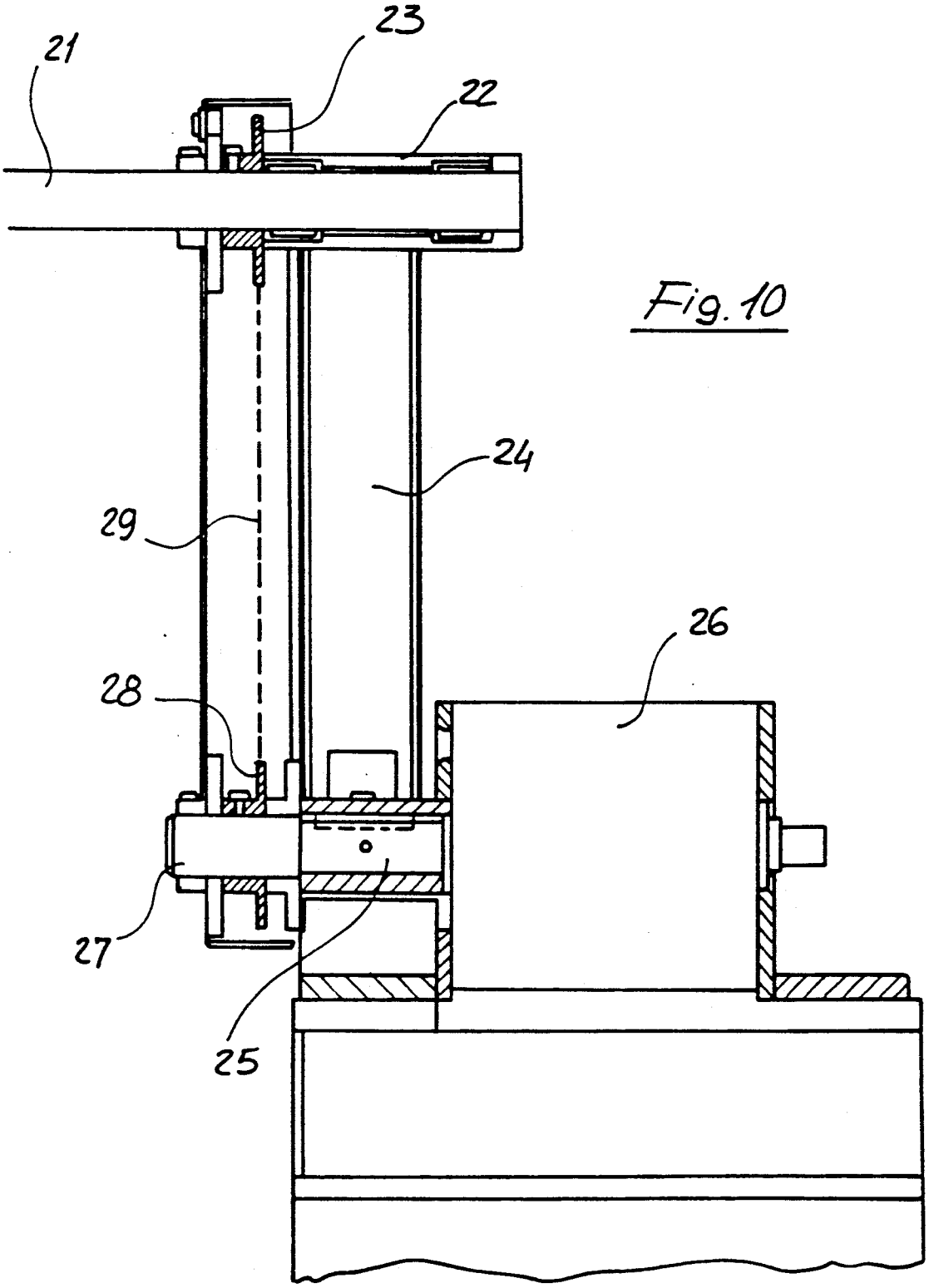
FIG. 10 shows a device for driving the above mentioned arm.
Figure 11:
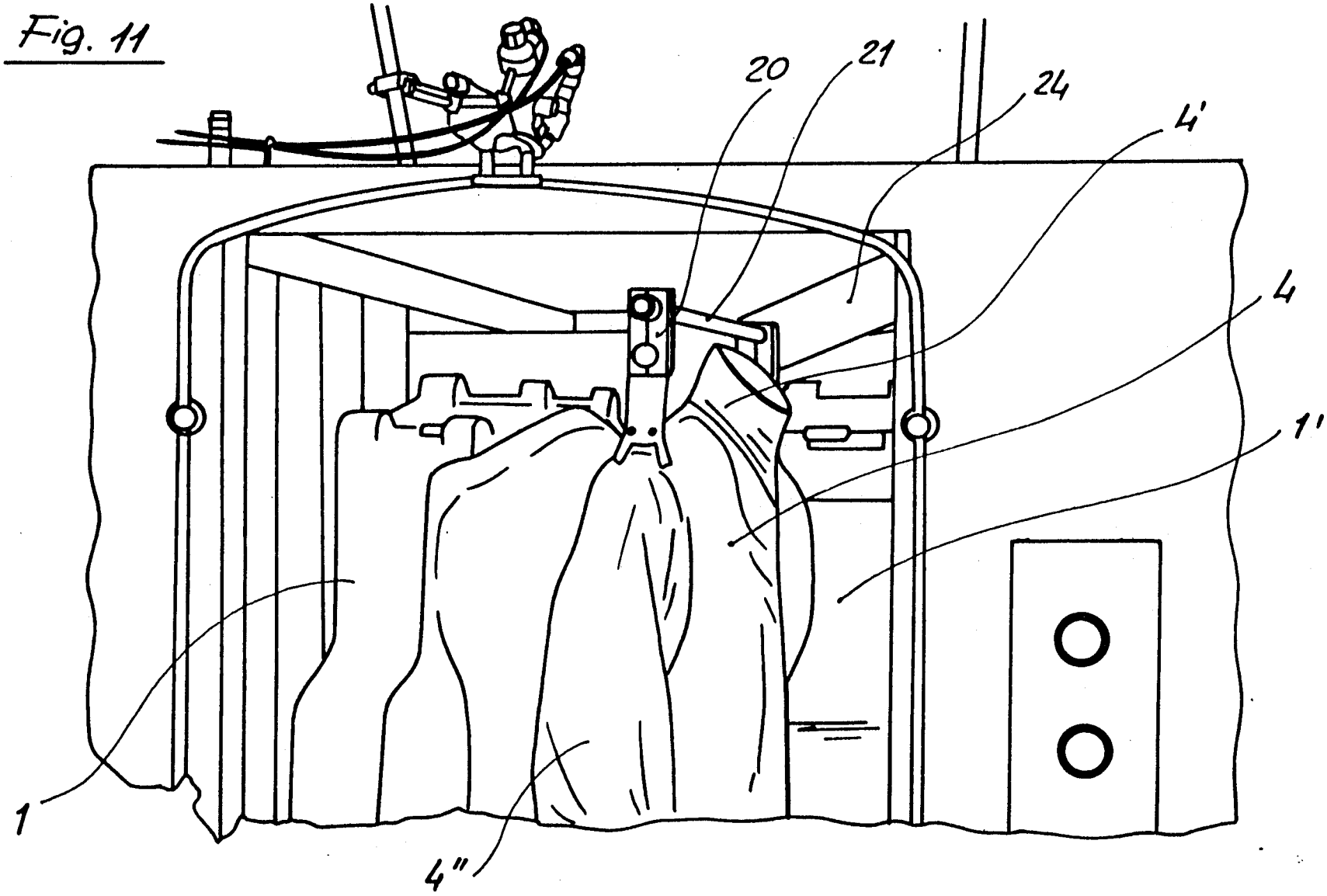
FIG. 11 shows a perspective view illustrating a top portion of the ironing apparatus according to the invention.

Thus, as the above mentioned arm is turned either in one or in the other direction, in order to grip and remove the ironed shirt, by means of the pliers 20, it will cause the tubular element 21 to correspondingly turn so as to always hold the pliers in a vertical arrangement (see FIG. 9).

From the above disclosure and the figures of the accompanying drawings it should be apparent that the invention fully achieves the intended aim and objects.

While the invention has been disclosed and illustrated with reference to a preferred embodiment thereof, it should be apparent that the disclosed embodiment is susceptible to several modifications and variations, all of which will come within the spirit and scope of the appended claims.

I claim:

1. An apparatus for automatically and simultaneously ironing front, rear and top portions of a shirt, comprising two vertical cooperating movable plates to be driven toward one another, a dummy bearing a shirt to be ironed located between said movable plates, said dummy including an upwardly movable top portion, said movable plates defining, at a top portion thereof, two concave seats one whereof extends from an intermediate discontinuous portion, said concave seats defining a negative profile of the top portion of said dummy, means being moreover provided for gripping and transferring the ironed shirt, said dummy being supported by a plate and said movable top portion of said dummy being upwardly displaced by a resiliently urged rod through a pressing cylinder, said dummy communicating with a negative pressure so as to cause said shirt to adhere to said dummy, said dummy being further provided with a top restraining element for restraining a neck portion of said shirt and with a pair of opposite cylinders for reciprocating corresponding rods to be introduced into sleeve portions of said shirt so as to hold said sleeve portions separated from said shirt as said shirt is ironed, one of said ironing plates comprising, at a portion of said dummy bearing said top restraining element, an intermediate interrupted portion having a half-round profile.

2. An apparatus according to claim 1, wherein said plate supporting said dummy bears, at a bottom portion thereof, a pair of fork elements provided with corresponding pairs of rollers sliding along two side portions of a first horizontal track, said supporting plate downwardly extending with a doubly bent portion bearing two grooved rollers sliding on a second supporting horizontal track.

3. An apparatus according to claim 1, wherein said apparatus further comprises a double acting cylinder having a stem articulated to said plate supporting said dummy for driving said drummy and said shirt to be ironed supported thereby between said ironing plates.

4. An apparatus according to claim 1, wherein said shirt gripping and transferring means comprise a pair of pliers mounted at corresponding end portions of a tubular element rotatably coupled to a supporting element and fixedly bearing a first gearwheel, said supporting element being firmly coupled to an arm mounted on a shaft rotatably reciprocating in two opposite directions by means of a driving reducing unit.

5. An apparatus according to claim 4 wherein, coaxially with said shaft, there is provided a fixed supporting element fixedly coupled to a second gear wheel cooperating with said first gear wheel for entraining a driving chain.

* * * * *